United States Patent [19]

Drake

[11] 4,386,653

[45] Jun. 7, 1983

[54] ANTI-GAS LOCKING APPARATUS

[76] Inventor: Eldon L. Drake, 25 La Donna Dr., Shawnee, Okla. 74801

[21] Appl. No.: 346,639

[22] Filed: Feb. 8, 1982

[51] Int. Cl.[3] ..... F04D 29/66; E21B 43/12

[52] U.S. Cl. ..... 166/105; 415/501; 166/243; 166/369

[58] Field of Search ..... 166/105, 105.5, 369, 166/370, 68, 68.5; 417/501; 415/501

[56] References Cited

U.S. PATENT DOCUMENTS

| | | | |
|---|---|---|---|
| 3,175,501 | 3/1965 | Carle | 415/501 |
| 3,291,057 | 12/1966 | Carle | 415/501 X |
| 3,936,225 | 2/1976 | Stjernstrom | 415/501 X |
| 4,088,459 | 5/1978 | Tuzson | 166/105.5 X |

*Primary Examiner*—Ernest R. Purser
*Assistant Examiner*—Thuy M. Bui
*Attorney, Agent, or Firm*—Laney, Dougherty, Hessin & Beavers

[57] ABSTRACT

An anti-gas locking apparatus for a downhole pump comprises a sleeve disposed below the pump and in fluid communication with the pump inlet, a housing disposed about the sleeve and fluidly communicating at its upper end with the well in which the pump is disposed, and a cross-over assembly communicating lower portions of the housing with the lower end of the sleeve. The cross-over assembly comprises a cross-over diffuser including a jacket member, the upper end of which mates with the lower end of the sleeve, and a dome member within the jacket member. Apertures are formed through the jacket member and dome member and webs extend between these members to form inlet passages into the interior of the dome member from the annulus between the housing and the sleeve and outlet passages about the dome member to the sleeve. An impeller is disposed within the jacket member below the dome member. Disclosed is an improved geometry of the cross-over diffuser in which webs forming the walls of the inlet and outlet passage spiral about the dome member with ever increasing vertical slope to a substantially vertical disposition and the diffuser is provided with similarly shaped flow shaping vanes within the outlet passages. The impeller is provided with vanes that increase in vertical dimension fromm the center of the impeller toward the periphery thereof so that, with the improved geometry of the diffuser, turbulence of well fluids passing through the diffuser is avoided to prevent evolution of gases in the diffuser.

3 Claims, 12 Drawing Figures

ANTI-GAS LOCKING APPARATUS

BACKGROUND OF THE INVENTION

1. Field of the Invention

The present invention relates generally to improvements in anti-gas locking devices for downhole pumps and, more particularly, but not by way of limitation, for downhole pumps used to raise mixtures of oil and water to the surface from an oil well.

2. Brief Description of the Prior Art

The fluids in the borehole of an oil well generally consist of a mixture of oil and water in which gases are guite often dissolved. These dissolved gases can be evolved by mechanical working of the liquid components of the fluid; for example, as will occur when the fluids are pumped to the surface, and such evolution of dissolved gases generally creates a problem where the pump used to raise well fluids is of the downhole centrifical type. The operation of this type of pump depends upon the pump being filled with a liquid so that, if evolved gases displace the liquid in the pump, the pump will be incapable of delivering fluids to the surface and, equally important, of clearing the gases so that a liquid can enter the pump. The result is that the pump is driven to no effect and is said to be gas locked.

In order to prevent the occurrence of gas locking in a downhole pump, it is known to equip the pump with an anti-gas locking apparatus that separates gas from the well fluids before such fluids enter the inlet of the pump and examples of such apparatus have been disclosed in U.S. Pat. No. 3,175,501 and U.S. Pat. No. 3,291,057, both of which are to Joseph T. Carle. An anti-gas locking apparatus of the type disclosed by Carle generally comprises a tubular sleeve through which a drive shaft for the pump passes from a downhole motor which is attached to the bottom of the anti-gas locking apparatus. The sleeve is disposed below the pump inlet and is mated therewith to discharge fluids introduced into the sleeve into the pump inlet. In addition, the anti-gas locking apparatus includes a housing which extends concentrically about the sleeve, and has openings into the well near its upper end so that well fluids can enter the housing, and a cross-over assembly that communicates the sleeve and housing at the lower end of the sleeve. Well fluids enter the openings in the housing, travel downwardly to the cross-over assembly, and reverse direction while passing therethrough to enter the lower end of the sleeve. The direction reversal tends to cause dissolved gases to be evolved from the well fluids in portions of the cross-over assembly underlying the annulus between the sleeve and housing so that such gases can escape through the housing openings to the well.

While most of the evolution of gases from the fluid takes place at a position in the anti-gas locking apparatus which will permit escape of the gases to the well, some gas will remain with the oil-water mixture and can be evolved at locations that will cause the gas to enter the sleeve. This residual gas can build up in the pump to cause gas locking of the pump and the prior art anti-gas locking devices are generally constructed to include some means for removing residual gases as they are evolved. The inclusion of such means, while effective for preventing gas locking, can, however, lower the efficiency of the pump or increase the cost of manufacturing thereof. For example, where a means is provided near the inlet of the pump to return the evolved residual gases to the well, such means will also generally return a portion of the pumped liquids to the well so that energy expended in pumping these liquids will be wasted.

SUMMARY OF THE INVENTION

The present invention provides an anti-gas locking apparatus which eliminates the problems associated with evolution of the residual gases in fluids passing through a cross-over assembly by means of an improved construction of such assembly. In particular, the cross-over assembly of the present invention is constructed to prevent turbulence of well fluids passing therethrough so that gases entrained in such fluids remain emulsified in the fluid to pass into and through a pump without causing gas locking of the pump.

The cross-over assembly of an anti-gas locking apparatus generally comprises a cross-over diffuser which, in turn, comprises a jacket member that is positioned in the lower portion of the housing of the anti-gas locking apparatus and has a reduced diameter upper portion that mates with the lower end of the sleeve of the apparatus. Within the jacket is a dome member positioned concentrically with the jacket member. Apertures are formed through both of these members and webs formed about the apertures connect the two members together. The webs completely surround the apertures so that the apertures and webs form inlet passages from the exterior of the jacket member to be interior of the dome member. The dome member has a lower end that is spaced above the lower end of the jacket member so that the fluids that are introduced into the dome member can pass into the spacing between the two members and thence into the lower end of the sleeve. Portions of such spacing between inlet passages thus form outlet passages for the cross-over diffuser. An impeller disposed in the jacket member below the dome member is rotated by the shaft between the motor and pump, such shaft being utilized to operate the pump, to drive well fluids through the cross-over assembly.

In the present invention, the jacket member has an intermediate frusto-conical portion that converges toward the reduced diameter portion that is mated with the sleeve and the dome member similarly has a frusto-conical outer surface that converges upwardly toward the sleeve. In particular, the angles of convergence for these frusto-conical elements are made to differ such that the dome member converges more rapidly than does the frusto-conical portion of the jacket member. The result is that the outlet passages for the cross-over diffuser diverge upwardly toward the lower end of the sleeve. In addition, webs that form the walls of the inlet and outlet passages are shaped to cause a gradual change in direction of fluids from a substantially radial direction at the lower end of the dome member to an axial direction at the upper end of the jacket member. To this end, the webs curve upwardly about the dome member such that portions of these webs adjacent the lower end of the dome member are disposed at a small angle with respect to a plane perpendicular to the axis of the diffuser while portions adjacent the upper end of the dome member are substantially parallel to the axis of the diffuser. The gradual transition of flow direction through the outlet passages of the diffuser is further enhanced by the inclusion therein of flow shaping vanes that curve upwardly about the dome member in the same manner that the webs forming walls of the passages curve upwardly thereabout. That is, lower portions of the flow shaping vanes are disposed at a small angle with respect to a plane perpendicular to the axis of the diffuser while upper portions of the flow shaping vanes are disposed substantially parallel to the axis of the diffuser.

In addition, the impeller of the cross-over assembly is also shaped in the present invention to minimize turbulence in the fluid exiting the diffuser. To this end, the vanes forming a portion of the impeller are curved from central portions thereof and, more importantly, gradually increase in vertical dimension from central portions of the impeller toward the periphery thereof. It has been found that these geometries of the cross-over diffuser and the impeller, in combination, result in substantially laminar flow of fluids through portions of the cross-over assembly from below the dome member to the upper end of the jacket member and through the sleeve member so that residual gases in well fluids passing through the cross-over assembly remain emulsified in the liquid components of such fluids and can be passed through the pump without giving rise to gas locking therein.

An object of the present invention is to provide a downhole pumping system which is substantially immune to gas locking problems.

Another object of the invention is to eliminate gas locking in a downhole pump while maintaining maximum efficiency for the pump.

Yet a further object of the invention is to provide an efficient but relatively inexpensive anti-gas locking apparatus for a downhole pump.

Other objects, advantages and features of the present invention will become clear from the following detailed description of the preferred embodiment of the invention when read in conjunction with the drawings and appended claims.

BREIF DESCRIPTION OF THE DRAWINGS

DESCRIPTION OF THE PREFERRED EMBODIMENT

Figure 1:
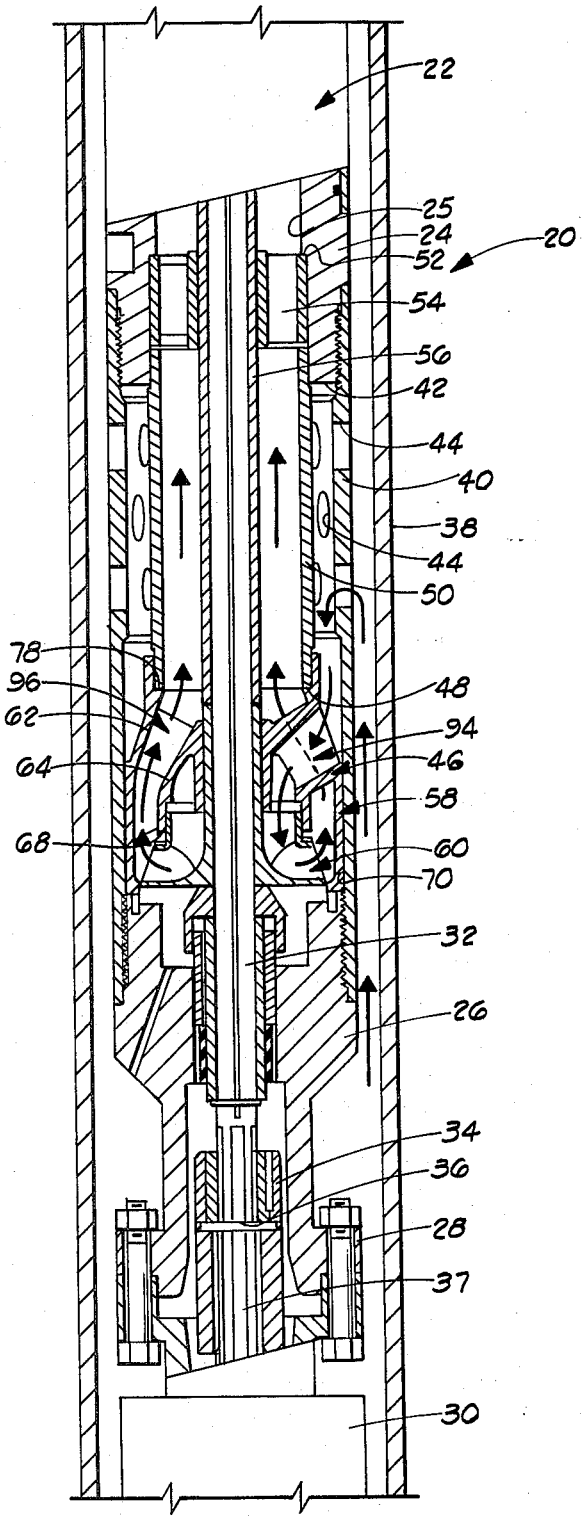
FIG. 1 is a cross section in side elevation of the improved anti-gas locking apparatus of the present invention.

Referring now to the drawings in general and to FIG. 1 in particular, shown therein and designated by the general reference numeral 20 is an improved anti-gas locking apparatus constructed in accordance with the present invention. The anti-gas locking apparatus 20 is suspended from a downhole pump 22 via a header 24 which has a central bore 25 formed therethrough to form an inlet for the pump 22. The anti-gas locking apparatus 20 comprises a lower header 26 having a flange 28 to which a downhole motor 30 is bolted when the pump is in use. A shaft 32 is rotatably supported in the pump 22 and anti-gas locking apparatus 20 via conventional bearings and a coupling 34 on the lower end 36 of the shaft 32 provides a means for connecting shaft 32 to the output shaft 37 of the motor so that the motor can be used to drive the pump 22. In use, the motor, pump and anti-gas locking apparatus are lowered as a unit into the casing 38 of an oil well and the motor is operated to acutate the pump to deliver fluids in the well to the surface via a tubing (not shown) connected to the top of the pump in the usual manner.

As shown in FIG. 1, the anti-gas locking apparatus 20 generally comprises a housing 40 which screws to the lower end 42 of the header 24 and to which the header 26 is screwed to form the anti-gas locking apparatus 20 into a unit between the pump 22 and the motor 30. The housing 40 is provided with a plurality of openings 44 (for clarity of illustration, only two of the openings 44 have been numerically designated in FIG. 1) to permit well fluids to enter the anti-gas locking apparatus 20 for subsequent discharge of such fluids into the inlet of the pump 22. The anti-gas locking apparatus 20 further comprises a cross-over assembly 46 which is disposed in lower portions of the housing 40 and supports the lower end 48 of a sleeve 50 within the housing 40. As will be clear from the discussion to follow, the cross-over assembly 46 is generally cylindrically symmetric and supports the sleeve 50 in a concentric relation with the housing 40 and further supports the sleeve 50 such that the upper end 52 thereof extends into the bore 25 of the header 24 to communicate with the inlet of the pump 22. The cross-over assembly 46 is constructed to provide a plurality of passages communicating the annulus between the sleeve 50 and the housing 40 with the interior of the sleeve 50 so that well fluids can enter the openings 44 in the housing 40, pass downwardly through such annulus, through the cross-over assembly 46 and thence upwardly through the interior of the sleeve 50 to the pump 22 to be discharged from the well in which the motor 30, the anti-gas locking apparatus 20 and pump 22 are disposed.

It will often be desirable to support the shaft 32 in its passage through the anti-gas locking apparatus 20 and a spider 54 and tubular bushing 56 can be provided for this purpose as shown in FIG. 1.

The cross-over assembly 46 generally comprises a cross-over diffuser 58 and an impeller 60 and the construction of these elements, partially shown in FIG. 1, is an important aspect of the present invention. The form of the cross-over diffuser 58, accordingly, has been illustrated in more detail in FIGS. 2 through 6 and the form of the impeller 60 has been illustrated in more detail in FIGS. 7 through 10. However, it will be useful at this point to note the general relationship between the cross-over diffuser 58 and the impeller 60 as has been shown in FIG. 1 before providing a detailed description of each of the cross-over diffuser 58 and impeller 60. As shown in FIG. 1, the cross-over diffuser 58 generally comprises a tubular jacket member 62 which rests on the header 26 and contains a tubular dome member 64, the jacket member 62 and dome member 64 having a common axis 66 which has been shown in FIG. 2. The lower end 68 of the dome member 64 is spaced a distance above the lower end 70 of the jacket member 62, as is more clearly shown in FIG. 5, so that well fluids entering the interior of the dome member 64 can pass between the inner surface of the jacket member 62 and the outer surface of the dome member 64 to the interior of the sleeve 50. The impeller 60 is disposed within lower portions of the jacket member 62, below the dome member 64 and is keyed to the shaft 32 so that rotation of the shaft 32 to drive the pump 22 concurrently turns the impeller 60 to drive well fluids drawn into the housing 40 through the cross-over assembly 46.

Figure 2:
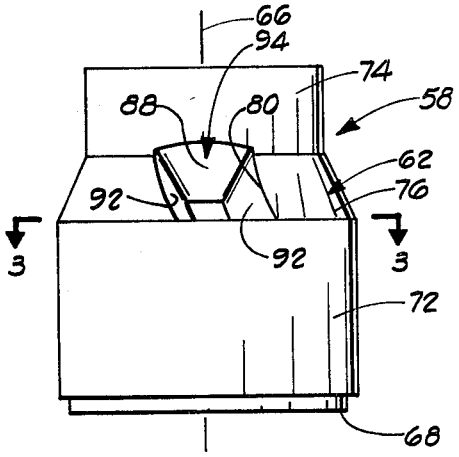
FIG. 2 is a side elevational view of the cross-over diffuser of the anti-gas locking apparatus of FIG. 1.
Figure 3:
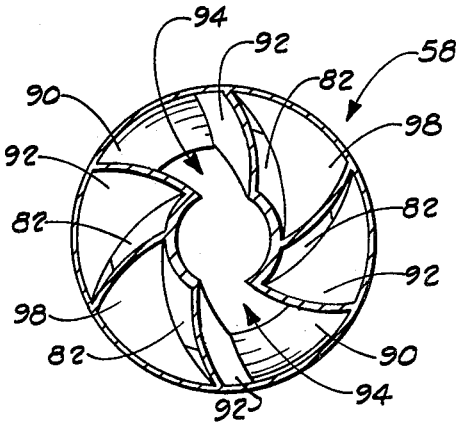
FIG. 3 is a cross section of the cross-over diffuser taken along line 3—3 of FIG. 2.
Figure 4:
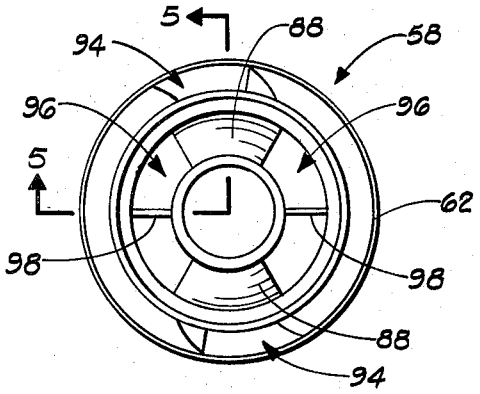
FIG. 4 is a plan view of the cross-over diffuser.
Figure 5:
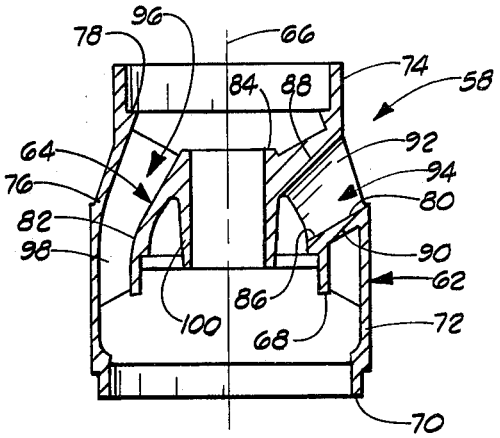
FIG. 5 is a cross section in elevation of the cross-over diffuser taken along line 5—5 of FIG. 4.
Figure 6:
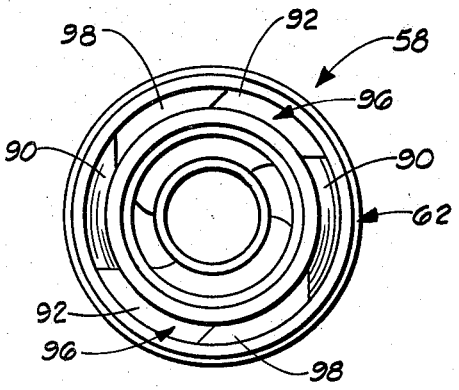
FIG. 6 is a bottom view of the cross-over diffuser.

Turning now to FIGS. 2 through 6, the jacket member 62 is seen therein to generally be divided into three portions: (1) a right circularly cylindrical lower portion 72; (2) a right circularly cylindrical upper portion 74 formed on a reduced diameter; and (3) a frusto-conical intermediate portion 76 connecting the upper portion 74 to the lower portion 72. As is particularly shown in FIGS. 1 and 3, a shoulder 78 is formed in the interior of the upper portion 74 of the jacket member 62 to support the lower end 48 of the sleeve 50 and communicate the annulus between the jacket member 62 and the dome member 64 with the interior of the sleeve 50. A pair of apertures 80 are formed through the jacket member 62 as shown in FIGS. 4 and 5 for a purpose to be discussed below. (Only one aperture 80 is shown in FIG. 5 which is a cross-section of the cross-over diffuser 58 along a line including a right angle bend to more clearly show the structure of the diffuser 58. The cross-section of the diffuser 58 in FIG. 1 is similarly along a line including a right angle bend in order to show the flow of fluids through the cross-over assembly 46.)

The dome member 64 has an outer surface 82 (FIGS. 3 and 5) which is also generally frusto-conical in form, such surface 82 converging upwardly as is particularly shown in FIG. 5. As is also shown particularly in FIG. 5, the surface 82 converges more rapidly than does the intermediate portion 76 of the jacket member 62 so that the annular spacing between the jacket member 62 and dome member 64 widens from the lower end 68 of the dome member 64 to the upper end 84 thereof. As in the case of the jacket member 62, a pair of apertures, one of which is indicated at 86 in FIG. 5, are formed through the dome member 64, each of the apertures 86 being positioned in radial alignment with an aperture 80 in the jacket member 62.

The cross-over diffuser 58 further comprises a plurality of webs formed intergally with the jacket member 62 and the dome member 64 in the annular spacing between these members, the webs extending about the apertures 80 and 86 to form inlet and outlet passages through the cross-over diffuser 58. In particular, as shown in FIGS. 2, 4 and 5, a roof web 88 is formed between the jacket member 62 and the dome member 64 above each of the sets of apertures 80 and 86 and a floor web 90 (FIG. 5) underlies each of these sets of apertures 80 and 86. In addition, a web 92 (FIGS. 1, 3 and 5) is disposed to either side of each set of apertures such that the webs 88, 90 and 92 isolate portions of the annular spacing between the jacket member 62 and the dome member 64 and cooperate with the apertures 80 and 86 to form inlet passages 94 (FIGS. 1, 4 and 5) that extend from the exterior of the intermediate portion 76 of the jacket member 62 to the interior of the dome member 64. Concurrently, the webs 92, which form walls for the inlet passages 94, break remaining portions of the annular spacing between the jacket member 62 and dome member 64 into two opposed outlet passages, which have been indicated at 96 in FIGS. 4, 5 and 6, that extend from the spacing between the lower ends, 70 and 68 respectively, of the jacket member 62 and dome member 64 to the top 84 of the dome member 64 to open into the lower end 48 of the sleeve 50.

An important aspect of the present invention is the shaping of the wall forming webs 92 as has been indicated in FIGS. 2 and 3. The webs 92 curve about the dome member 64 with an ever increasing slope such that, as indicated in FIG. 3, lower portions of the web 92 make only a small angle with respect to a plane perpendicular to the axis 66 of the cross-over diffuser 58. However, as indicated in FIG. 2, the upper portions of the webs 92 are substantially vertically disposed; that is, the upper portions of the webs 92 approach a disposition parallel to the axis 66 near the upper end of the jacket member 62. Such shaping of the webs 92, in conjunction with the widening of the outlet passage 96 effected by the difference in the rates of convergence of the intermediate portion 76 of the jacket member 62 and the surface 82 of the dome member 64, tends to shape the flow of fluid through the outlet passages 96 into a laminar flow which prevents the evolution of gases dissolved in liquid components of such fluid. This flow shaping of fluid through the outlet passages 96, to cause such flow to be laminar, is further enhanced by the inclusion in the cross-over diffuser of a flow shaping vane 98 (FIGS. 3 through 6) in each of the outlet passages 96 substantially equidistant to the wall forming webs 92 that define the boundaries of each of the outlet passages 96. These flow shaping vanes are substantially identical to the webs 92, each such vane 98 curving about the dome member 64, as shown in FIG. 3, with an ever increasing vertical slope such that lower portions of each vane 98 make only a small angle with respect to a plane perpendicular to the axis 66 while upper portions of each vane are substantially parallel to the axis 66.

In the preferred embodiment of the cross-over diffuser 58, the diffuser further comprises a tubular hub 100 which is formed integrally with the dome member 64 and extends downwardly about the axis 66 to receive and position the impeller 60 within the diffuser 58.

Figure 7:
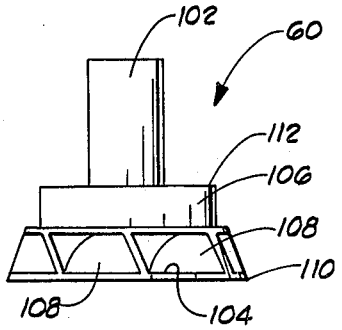
FIG. 7 is a side elevational view of the impeller of the cross-over assembly of the present invention.
Figure 8:
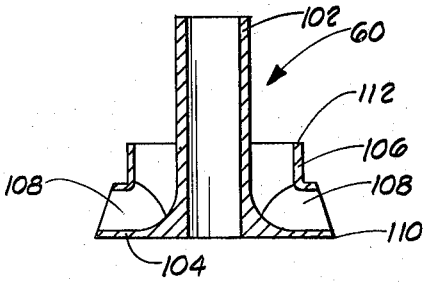
FIG. 8 is a cross section in side elevation of the impeller shown in FIG. 7.
Figure 9:
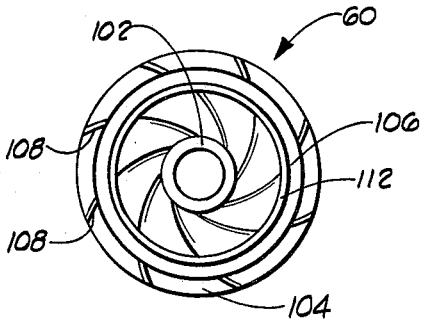
FIG. 9 is a plan view of the impeller shown in FIG. 7.

The impeller 60 is more particularly shown in FIGS. 7 through 9 to which attention is now invited. In general, the impeller 60 comprises a tubular hub 102 through which the shaft 32 passes and the hub 102 is pinned to the shaft 32 by conventional means (not shown) in the assembly of the anti-gas locking apparatus 20 such that the rotation of the shaft 32 to drive the pump 22 will also turn the impeller 60. In the assembled cross-over assembly 46, upper portions of the hub 102 are disposed within the hub 100 as has been shown in FIG. 5.

The impeller 60 further comprises a floor plate 104 at its lower end and a flanged ring 106 spaced a distance above the floor plate 104 to mate with portions of the dome member 64, adjacent the lower end 68 thereof, as has been shown in FIG. 1. The impeller 60 also further comprises a plurality of curved vanes 108 disposed between the floor plate 104 and the ring 106, the vanes 108 spiraling outwardly from the hub 102 to the outer periphery of the impeller 60 as defined by the periphery 110 of the floor plate 104. An important aspect of the present invention resides in the shaping of the vanes 108 as is particularly shown in FIG. 8. In prior art impellers of cross-over assemblies, it has been common practice to extend radially inwardly disposed portions of the vanes of the impellers upwardly to substantially the top 112 of the ring 106 in keeping with the general prior art approach of causing evolution of gases from well fluids at the top of the ring whence the gases are allowed to escape via the inlet passages 94 and housing 40 to the well. That is, the upward extension of the vanes of the impeller of prior art cross-over assemblies is designed to create turbulence which will cause outgasing of the well fluids. However, the general flow of well fluids through the impeller to the outlet passages 96 can defeat such purpose by transporting evolved gases into the outlet passages 96 and thence to the sleeve 50. In the present invention, the vanes 108 are constructed to prevent evolution of gases within the cross-over diffuser 58 by minimizing turbulence therein and, to this end, the radially innermost portions of the vanes 108 are provided with only a small vertical dimension, as shown in FIG. 8, such dimension increasing as the vane progresses toward the periphery of the impeller 60.

Another important aspect of the present invention resides in the openings 44 into the housing 40. In many circumstances, the casing 38 of the well in which the pump 22, anti-gas locking apparatus 20 and motor 30 will be used will have a standard inside diameter so that the diameter of the housing 40 can be selected with such inside diameter of the casing 38 in mind. In such circumstances, it has been found that substantial outgasing of well fluids at the openings 44 can be effected by selecting the diameter of the housing 40 and the sizes and numbers of the openings 44 such that the combined cross sectional area of the openings is substantially twice the cross sectional area of the annular spacing between the housing 40 and the casing 38.

OPERATION OF THE PREFERRED EMBODIMENT

In operation, the anti-gas locking apparatus 20, along with the pump 22 and motor 30, are lowered into the casing 38 of a well to submerge these devices in well fluids which are to be brought to the earth's surface. The motor 30 is then operated to drive the pump 22 and rotate the impeller 60 of the cross-over assembly 46. The combined operation of the pump 22 and rotation of the impeller 60 then establishes a flow of well fluids into the anti-gas locking apparatus 20 and therethrough to the pump 22 as has been indicated by the heavy arrows impressed upon FIG. 1. In particular, well fluids move upwardly between the housing 40 and the casing 38 to enter the openings 44 in the housing 40. Within the housing 40, the well fluids move downwardly to enter the inlet passages 94 and are discharged therefrom into the interior of the dome member 64. The impeller 60 then forces these fluids to the outlet passages 96 from which the fluids are discharged into the sleeve 50 for delivery to the inlet of the pump 22. The pump 22 then delivers the fluids to the earth's surface.

The above described configurations of the elements of the cross-over assembly 46, in conjunction with the sizes of the openings 44 in the casing 40, prevent gas locking of the pump 22 as will now be explained. Initially, the selection of the openings 44 to have a combined cross sectional area of substantially twice the cross sectional area of the annulus between the housing 40 and casing 38 causes an initial slowing of the well fluids as they enter the openings 44. This change in flow velocity of the fluids results in turbulent flow of the fluids at the openings 44 with the result that large scale outgasing of the fluids occurs at these openings and the evolved gas escapes to the well. As the well fluids subsequently pass through the inlet passages 94, they are discharged onto central portions of the rotating impeller 60 for delivery to the outlet passages 96. Since the vanes 108 of the impeller 60 have a small vertical dimension near the hub 102 of the impeller 60, such dimension increasing with radial distance from the hub 102, forces exerted on the well fluids by the impeller 60 gradually increase from the hub 102 to the periphery 110 of the impeller 60 so that a slowly varying change in the flow direction of fluids passing through the impeller occurs to prevent turbulence, which could cause outgasing of the well fluids, within the impeller. The fluids then pass through the outlet passages 96 and the shaping of these passages again causes a slowly varying change in the flow direction of the fluids; that is, the low angle between lower portions of the wall forming webs 92 and the vanes 98 with a plane perpendicular to the axis 66 of the cross-over assembly 46 and the nearly vertical slope of upper portions of these webs and vanes causes the direction of flow of well fluids in the outlet passages 96 to slowly change from a substantially radial direction to a substantially axial direction with respect to the axis 66. In addition, the slow divergence of the outlet passages 96 toward their upper ends, caused by the differing angles of convergence of the intermediate portion 76 of the jacket member 62 and the surface 82 of the dome member 64, slows the well fluids gradually as they pass through the outlet passages 96 such that the fluids will not experience an abrupt change in flow velocity as they enter the sleeve 50. The overall result of these features, in combination, is that the fluid flow through the cross-over assembly 46 is substantially laminar so that residual gases in the well fluids remain emulsified therein as they enter the inlet of the pump 22 so that gas locking of the pump 22 will not occur. Thus, in the present invention, rather than removing gases that may be evolved from well fluids within the cross-over assembly 46 and the sleeve 50, such gases giving rise to a possibility of gas locking of the pump 22, such possibility is eliminated by shaping components of the cross-over assembly 46 such that residual gases dissolved in well fluids subsequent to the initial outgassing at the openings 44 through the housing 40 will remain dissolved within the well fluids as such fluids enter the pump and are delivered to the surface with the liquid components of such fluids.

DESCRIPTION OF FIGS. 10 THROUGH 12

Figure 10:
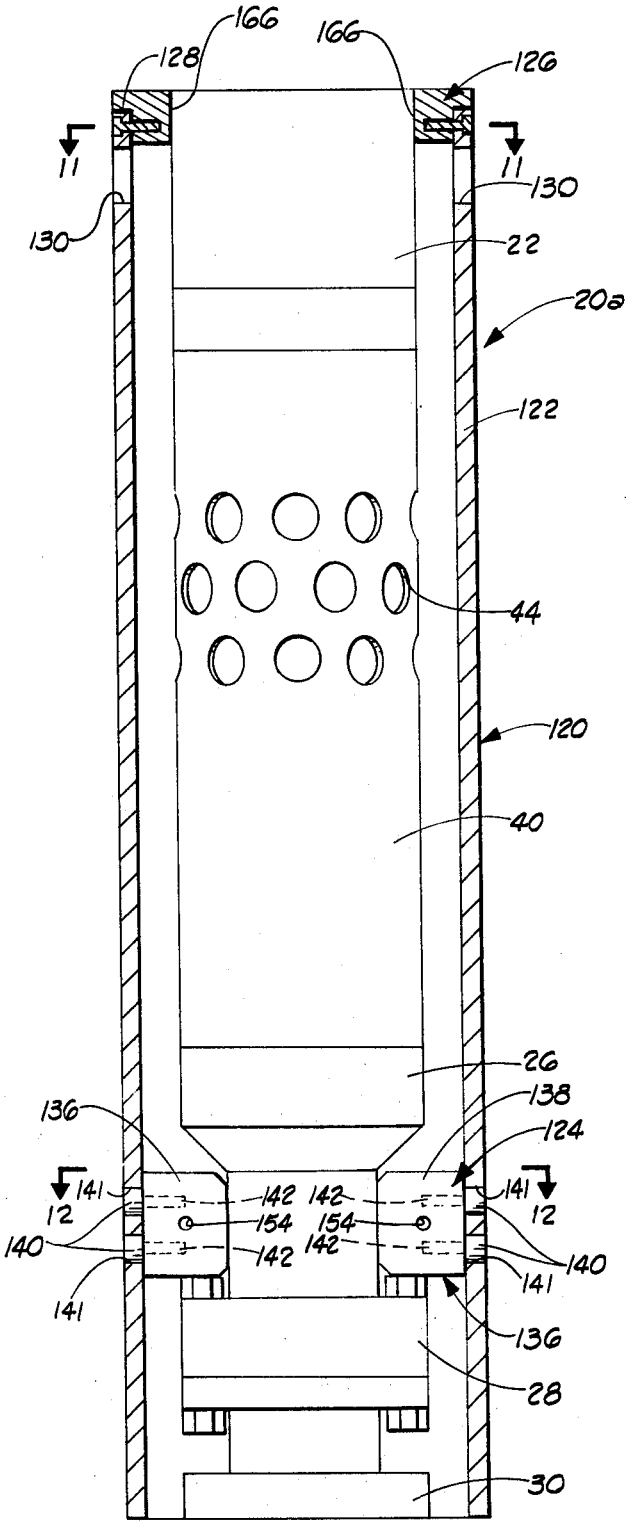
FIG. 10 is an elevational view in partial cross section of a second embodiment of the anti-gas locking apparatus of the present invention.
Figure 11:
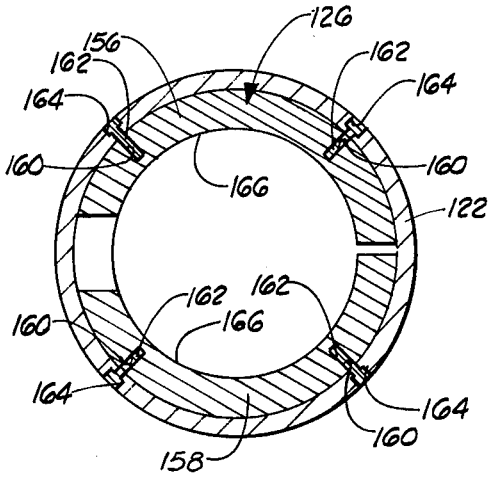
FIG. 11 is a partial cross sectional view of the anti-gas locking apparatus of FIG. 10 taken along line 11—11 of FIG. 10.
Figure 12:
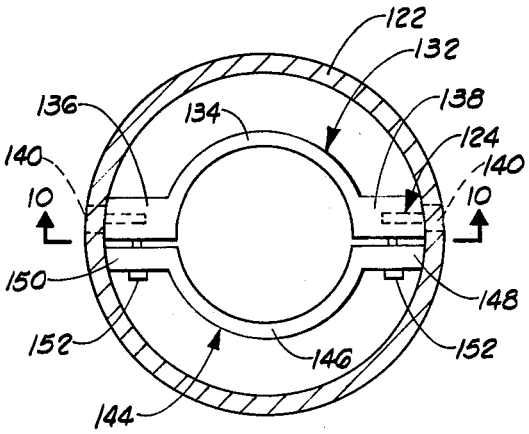
FIG. 12 is a partial cross sectional view of the anti-gas locking apparatus of FIG. 10 taken along 12—12 of FIG. 10.

FIGS. 10 through 12 illustrate a second embodiment, designated by the reference numeral **20*a*, of the anti-gas locking apparatus of the present invention which is particularly suited for use in wells having a relatively large diameter casing. The anti-gas locking apparatus disclosed in these figures includes all of the elements of the anti-gas locking apparatus 20 as has been indicated by the designation of the housing of the apparatus 20*a* by the reference numeral 40 used for the housing of the apparatus 20 and a similar designation of the openings through the housing by the numeral 44 in FIG. 10. The anti-gas locking apparatus 20a comprises, in addition to all of the components of the anti-gas locking apparatus 20, a shroud assembly 120 which is mounted on the header 26 of the anti-gas locking assembly 20a and pump 22**.

In particular, the shroud assembly 120 comprises a tubular shroud 122 which extends about the housing 40; a clamp assembly 124; and an alignment ring 126 that is secured to the inner periphery at the shroud 122 and cooperates with the clamp assembly 124 to lock the shroud assembly to the motor 22 and casing 40. Portions of the shroud 122 near the upper end 128 thereof are provided with apertures 130 to permit any gases evolved from well fluids at the openings 44 to be discharged from the shroud 122 to the well.

The clamp assembly 124 comprises a first clamping member 132 which has a central semi-circular portion 134 to engage portions of the header 26 above the flange 28. As shown in FIG. 12, wings 136, 138 extend laterally of the semi-circular portion 134 to engage the inner surface of the shroud 122 so as to position lower portions at the shroud 122 in a concentric relation with the housing 40. (For clarity of illustration, the header 26 has not been shown in FIG. 12.) Radially extending threaded holes 142 are formed in the wings 136, 138 to receive cap screws 140 as shown in FIG. 10 for locking the shroud assembly 122 to the casing 40 and motor 22 as will be discussed below. It will suffice at this point to note that holes 141 are drilled through the shroud 122 to align with the holes 142 and mate with the heads of the cap screws 140 when the shroud assembly 120 is mounted on remaining portions at the anti-gas locking assembly 20a. The clamp assembly further includes a second clamping member 144 which similarly comprises a semi-circular portion 146 which engages the header 26 and wings 148, 150 which extend from the semi-circular portion 146 to engage the inner surface of the shroud 122. The clamp is assembled via bolts 152 that extend through holes (not shown) in the wings 148, 150 of the second clamping member 144 and screw into threaded holes 154 (FIG. 10) in the wings 138, 140 of the first clamping member 132.

The alignment ring is conveniently constructed in two substantially semi-circular sections 156, 158 as has been shown in FIG. 11. Each of these sections is provided with a plurality of radially extending threaded holes 160 to permit the alignment ring 126 to be positioned within the shroud 122 and secured thereto via bolts 162 that extend through holes 164 drilled through the shroud 122 and screw into the holes 160 in the alignment ring 126. The inner surfaces 166 of the sections 156, 158 are sized to mate with the outer periphery of the motor 22 such that the alignment ring 126 will position upper portions of the shroud 122 concentrically with the housing 40.

The shroud assembly 120 is conveniently mounted on remaining portions of the anti-gas locking apparatus 20a when such apparatus is assembled to the motor 30 and the pump 22 prior to entering these devices into a well. In particular, after the remaining portions of the anti-gas locking apparatus 20a has been assembled with the pump 22 and motor 30, the clamp assembly 124 is mounted on the header 26 with the cap screws 140 removed. The shroud 122, with alignment assembly 126 mounted therein, can then be placed over the pump 22 and moved therealong until the holes 141 formed through the shroud 122 align with the holes 142 in the first clamping member 132 of the clamp assembly 124. The bolts 140 are then inserted through the holes in the shroud 122 and screwed into the holes 142 to lock the shroud assembly to remaining portions of the anti-gas locking assembly 20a and the pump 22.

The anti-gas locking apparatus 20a operates substantially identically to the anti-gas locking apparatus 20. In particular, the shroud 122 and housing 40 define an annulus through which well fluids pass to enter the openings in the housing 40. The combined cross sectional area of these openings is made substantially twice the cross sectional area between the housing 40 and the shroud 122 so that substantial outgassing of well fluids occurs at the openings 44 as occurs for the anti-gas locking apparatus 20. The well fluids are then passed through the housing 40, the cross-over assembly 46 and sleeve 50 of the apparatus 20a in a laminar flow to prevent outgassing of such fluids within the apparatus 20a in the same manner that outgassing is prevented in the apparatus 20.

It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In an apparatus for preventing gas locking of a downhole pump, said apparatus being of the type suspended from the pump and having a tubular sleeve communicating at its upper end with the inlet of the pump, a tubular housing disposed concentrically about the sleeve and having openings through upper portions thereof to receive well fluids into the annulus between the sleeve and the housing, and a cross-over assembly fluidly communicating said annulus with the interior of the sleeve, the cross-over assembly including:

a cross-over diffuser including:

a jacket member having a lower portion disposed within lower portions of the housing, a reduced diameter upper portion mating with the lower end of the sleeve, and a frusto-conical intermediate portion between said upper and lower portions, wherein a plurality of apertures are formed through said intermediate portion of the jacket member;

an upwardly converging dome member disposed within the intermediate portion of said jacket member and having an aperture formed therethrough for each aperture formed through the jacket member, said dome having a lower end spaced a selected distance above the lower end of the jacket member; and a plurality of webs connecting the jacket member to the dome member about each set of apertures formed through the jacket member and the dome member so as to form with each set of apertures an inlet passage from said annulus to the interior of the dome member and so as to form a plurality of outlet passages from the interior of the dome to the upper portion of the jacket member; and an impeller disposed within the lower portion of the jacket member, the improvement wherein:

the dome member converges more rapidly than the intermediate portion of the jacket member such that said outlet passages radially diverge toward the upper portion of the jacket member;

webs disposed to either side of apertures formed through the jacket member and the dome member curve about the dome member with an ever increasing vertical slope such that portions of such webs adjacent the upper portion of the jacket member are disposed substantially parallel to the axis of the housing and sleeve and portions of such webs adjacent the lower end of the dome member make a small angle with a plane perpendicular to said axis of the housing and sleeve;

the vanes of the impeller increase in vertical dimension from central portions of the impeller toward the outer periphery thereof; and wherein the cross-over diffuser further comprises a flow shaping vane spiraling about said dome member within each of the outlet passages substantially equidistant to the webs forming the walls of the inlet and outlet passages, said flow shaping vanes having an ever increasing upward slope from the lower end of said dome member to the upper end of said dome member such that upper portions of said flow shaping vanes are disposed substantially parallel to the axis of the housing and sleeve and lower portions thereof make a small angle with a plane perpendicular to said axis of the housing and sleeve.

2. The apparatus of claim 1 wherein said housing of said apparatus is characterized as having a preselected diameter relative to the inner diameter of a well casing for a well wherein said downhole pump is disposed so as to define an annulus between said housing and said well casing of a preselected cross-sectional area and wherein the openings through upper portions of the housing are characterized as having a combined cross sectional area of substantially twice the cross sectional area of the annulus between the housing and the well casing.

3. The apparatus of claim 1 further comprising a tubular shroud mounted on said housing and extending concentrically thereabout so as to define an annular spacing extending about said openings into said housing, and wherein the openings into said housing are characterized as having a combined cross-sectional area of substantially twice the cross-sectional area of the spacing between said housing and said shroud.

* * * * *